US005540492A

United States Patent [19]

Dasher et al.

[11] Patent Number: 5,540,492

[45] Date of Patent: Jul. 30, 1996

[54] SNAP-IN HUMIDITY CONTROL FOR CRISPER PANS

[75] Inventors: James F. Dasher; Mark A. Stout, both of Evansville, Ind.

[73] Assignee: Whirlpool Corporation, Benton Harbor, Mich.

[21] Appl. No.: 380,909

[22] Filed: Jan. 30, 1995

[51] Int. Cl.[6] ..... A47B 96/04

[52] U.S. Cl. ..... 312/404; 312/407; 312/407.1; 312/330.1; 62/449; 62/265; 62/408

[58] Field of Search ..... 312/404, 407, 312/407.1, 348.4, 348.6, 309; 62/449, 265, 408

[56] References Cited

U.S. PATENT DOCUMENTS

| | | | |
|---|---|---|---|
| 2,709,900 | 6/1955 | Zearfoss, Jr. . | |
| 4,013,434 | 3/1977 | Kronenberger et al. . | |
| 4,250,719 | 2/1981 | Grimm et al. . | |
| 4,475,775 | 5/1988 | Bussan et al. . | |
| 4,557,118 | 12/1985 | Pink et al. . | |
| 4,745,775 | 5/1988 | Bussan et al. | 312/330.1 X |
| 4,768,353 | 9/1988 | Bushser | 62/408 |
| 4,850,206 | 7/1989 | Larsen . | |
| 5,040,856 | 8/1991 | Wilkins et al. . | |
| 5,191,774 | 3/1993 | Park | 62/408 |
| 5,385,032 | 1/1995 | Martin et al. | 312/407.1 X |
| 5,437,503 | 8/1995 | Baker et al. | 312/404 |

*Primary Examiner*—Peter M. Cuomo
*Assistant Examiner*—Rodney B. White
*Attorney, Agent, or Firm*—Thomas J. Roth; Mark A. Davis

[57] ABSTRACT

A humidity control assembly is provided for use with a refrigerator crisper pan which is constructed to snap into a plain opening in a wall of the crisper pan. The humidity control assembly is formed of two pieces, a slide body having detents for securing the body in the wall of the crisper pan and a track for receiving a control slide member. The control slide member is received in the track and can slide to change the effective size of an opening through the slide body. No additional fasteners are required to hold the humidity control assembly in the crisper pan and no special molding or machining is required for the crisper pan.

16 Claims, 3 Drawing Sheets

FIG. 1
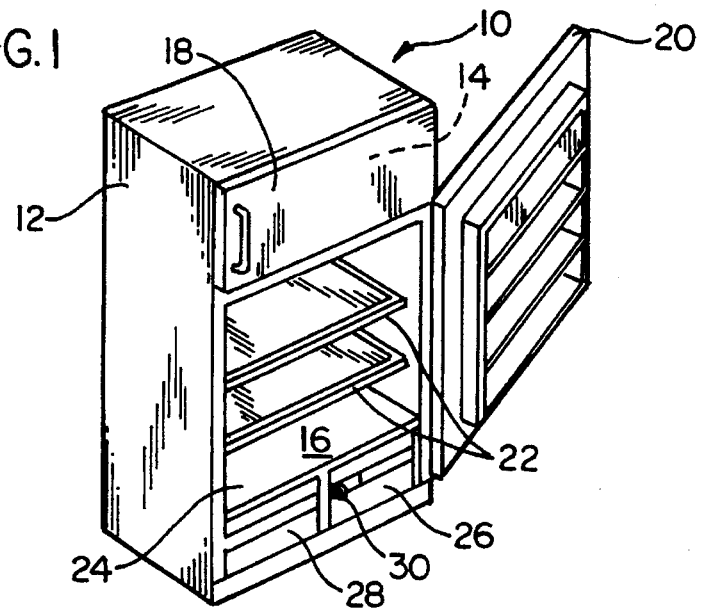
FIG. 2
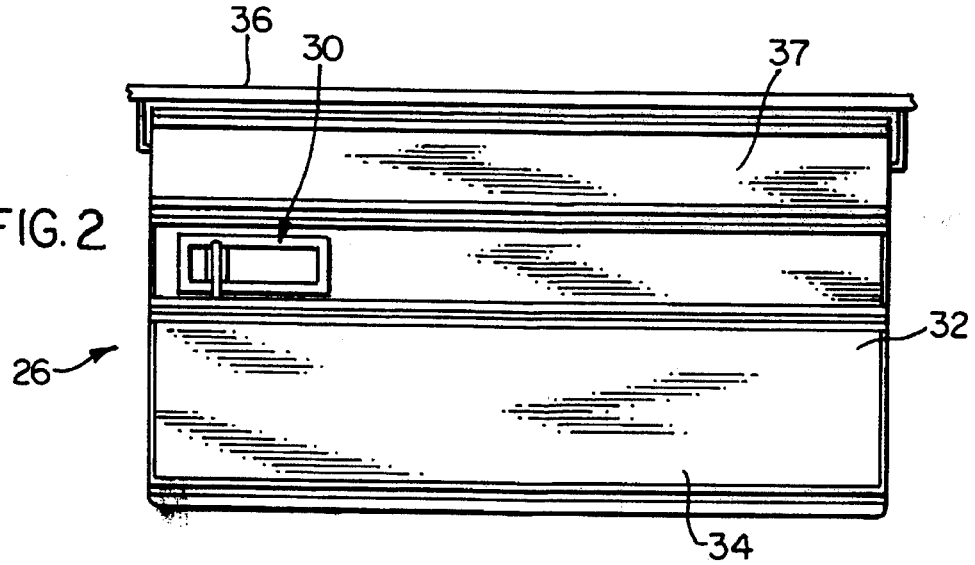
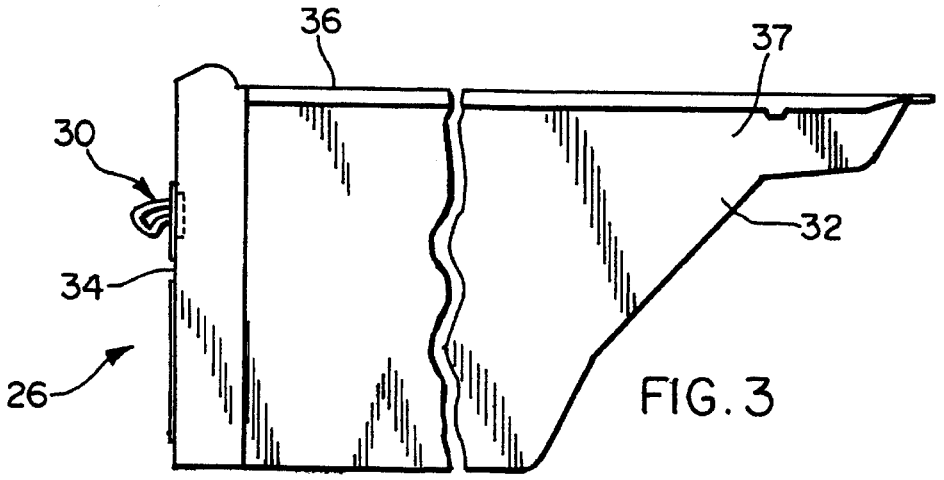
FIG. 3

SNAP-IN HUMIDITY CONTROL FOR CRISPER PANS

BACKGROUND OF THE INVENTION

The present invention is directed to a humidity control device for a crisper pan used in a refrigeration appliance and more particularly to a humidity control device which snaps into the crisper pan.

Humidity control devices for crisper pans are well known in the art. For example, in U.S. Pat. No. 4,745,775, assigned to the assignee of the present invention, there is disclosed a humidity control device which includes a housing the slide member which can be moved in the housing. The slide member is used to selectively open and close a passage through the housing. The housing is to be snapped into engagement with the front panel of the crisper drawer in that there is a flexible latching hook which is mounted on the front panel to resiliently engage the housing and hold the housing against a back surface of the front panel. Other ridges are provided on the front panel to assist in positioning the housing relative to the front panel. The front panel has an opening therethrough aligned with the opening in the housing such that the effective size of the opening through the front panel and housing can be controlled by movement of the slide.

SUMMARY OF THE INVENTION

The present invention provides a two piece assembly humidity control device which allows for the installation of a humidity control feature into a plain slot in the front wall of a crisper pan. This two piece assembly differs from prior designs in that there are no mating features, such as snap fit details or other molded-in mating details, formed in the crisper pan, just a rectangular opening in the pan front wall. This simplifies the tooling required to produce the crisper pan in that no cams or lift mechanisms are required. While some other designs utilize screws to assemble the control to the pan, the present invention provides for assembly without additional fasteners.

The humidity control device comprises two components, a body, which contains slot openings, a track for the control slide to move in, and snap fit details to hold the assembly in the crisper pan; and a slide, which varies the amount of opening in the body.

By varying the amount of opening into the crisper pan, varying degrees of humidity can be achieved within the pan. Since different foods have different requirements for humidity during storage this feature allows the customer to adjust the storage condition to match the requirements of the food being stored. The design disclosed herein protrudes minimally into the pan interior and does not adversely affect the storage volume of the pan.

BRIEF DESCRIPTION OF THE DRAWINGS

FIG. 1 is perspective view of a refrigerator cabinet having a pan assembly and humidity control embodying the principles of the present invention.

FIG. 2 is a front elevational view of the pan assembly embodying the principles of the present invention.

FIG. 3 is a side sectional view of a pan of FIG. 2.

DETAILED DESCRIPTION OF THE PREFERRED EMBODIMENTS

Figure 4:
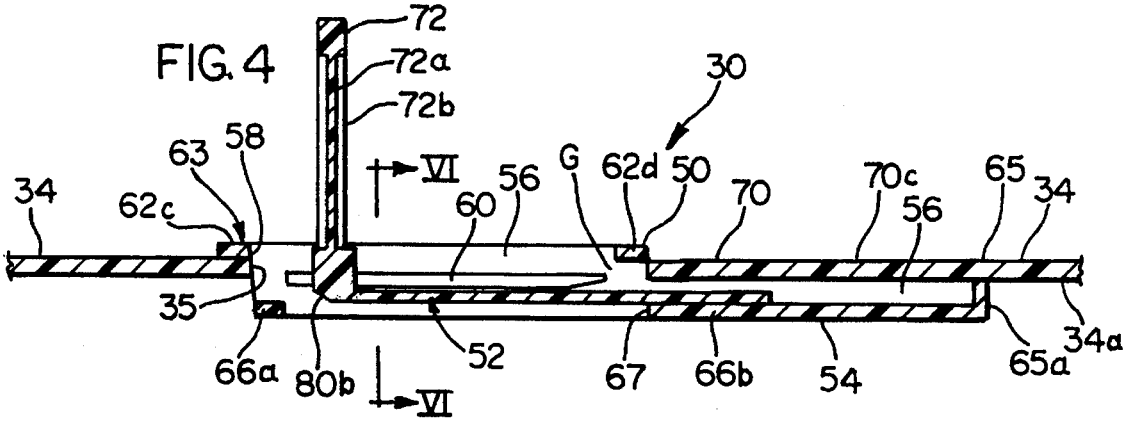
FIG. 4 is a side sectional view of the humidity control device in place in the pan wall.
Figure 5:
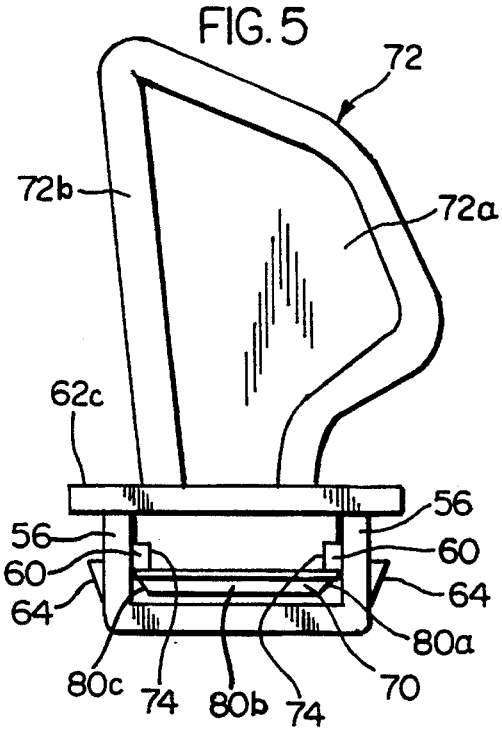
FIG. 5 is an end elevational view of the humidity control assembly of FIG. 4.
Figure 6:
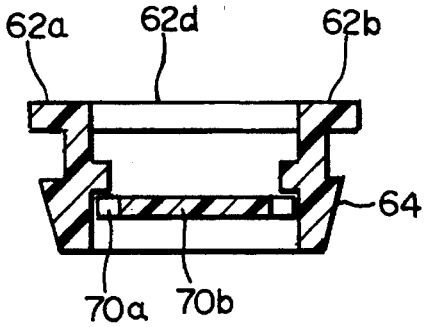
FIG. 6 is a sectional view taken generally along VI—VI of FIG. 4.
Figure 7:
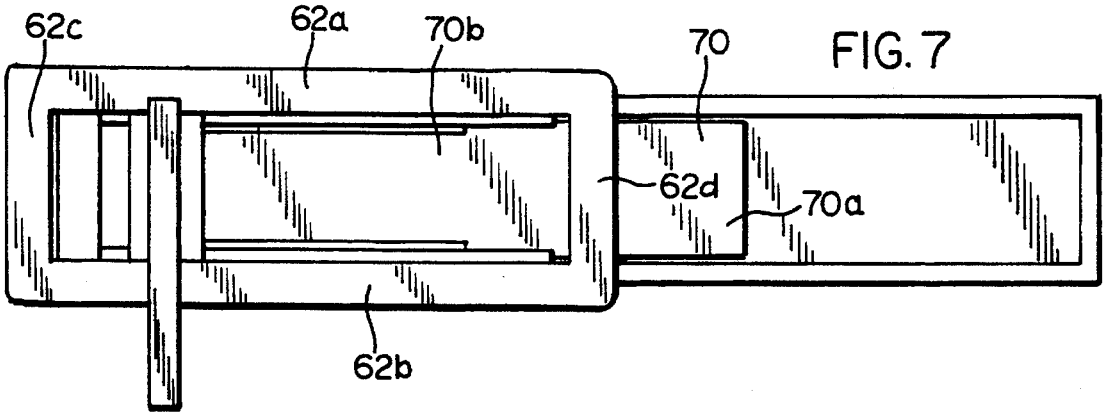
FIG. 7 i a plan view of the humidity control assembly in isolation.

A refrigeration apparatus, such as a combination refrigerator/freezer 10 is illustrated in FIG. 1 which includes a pan assembly with a humidity control in accordance with the principles of the present invention. Although a refrigeration appliance having a top freezer compartment and a lower refrigeration compartment is shown, other types of refrigeration apparatus might be used in conjunction with the present invention, as will be obvious to those skilled in the art.

The refrigerator/freezer 10 includes a cabinet 12 defining a below-freezing, or freezer compartment 14 and a fresh-food or above-freezing compartment 16. A freezer door 18 and a fresh-food compartment door 20 are provided for selective access to the freezer and fresh-food compartments 14, 16 respectively.

The freezer and fresh-food compartments 14, 16 are cooled by circulating air therethrough which has been refrigerated as a result of being passed in a heat exchange relation with a conventional evaporator (not shown). In addition to the evaporator, the refrigerator/freezer includes connected components (not shown) such as a compressor, a condenser, a condenser fan, and an evaporator fan as will be obvious to those skilled in the art.

The fresh-food compartment 16 includes a plurality of upper shelves 22. Also provided in a fresh-food compartment is a lower shelf 24. In the preferred embodiment, the lower shelf is of solid construction and may be, for example, high strength glass or plastic.

A pair of storage pan assemblies 26, 28 according to the invention are disposed within the fresh food compartment 16 below the lower shelf 24. The storage pans 26, 28 may be of similar construction. One of the storage pans, such as pan 28, should include a humidity control 30 thereon. If desired, both storage pans 26 and 28 could include a humidity control 30. A storage pan assembly 26 with the humidity control 30 provides a pan for the storage of food such as vegetables and provides means to control the moisture content of the storage pan assembly to preserve freshness of the vegetables and prevent them from being prematurely damaged.

The storage pan assembly 26 is illustrated in greater detail in FIGS. 2 and 3. The pan assembly 26 includes a storage pan 32 including an integral front wall 34 with a small rectangular opening 35 therein (shown in FIG. 4). Storage pan 32 has an upwardly open top portion 36 defining a storage cavity 37 wherein articles to be refrigerated may be stored. The storage pan 32 is preferably fabricated of molded plastic, although other materials might be used as will be obvious to those skilled in the art. The front wall 34 has the rectangular opening 35 therein.

The humidity control 30 of the present invention is illustrated in greater detail in FIGS. 4–10 and includes two components, a body member 50 and a slide member 52.

Figure 8:
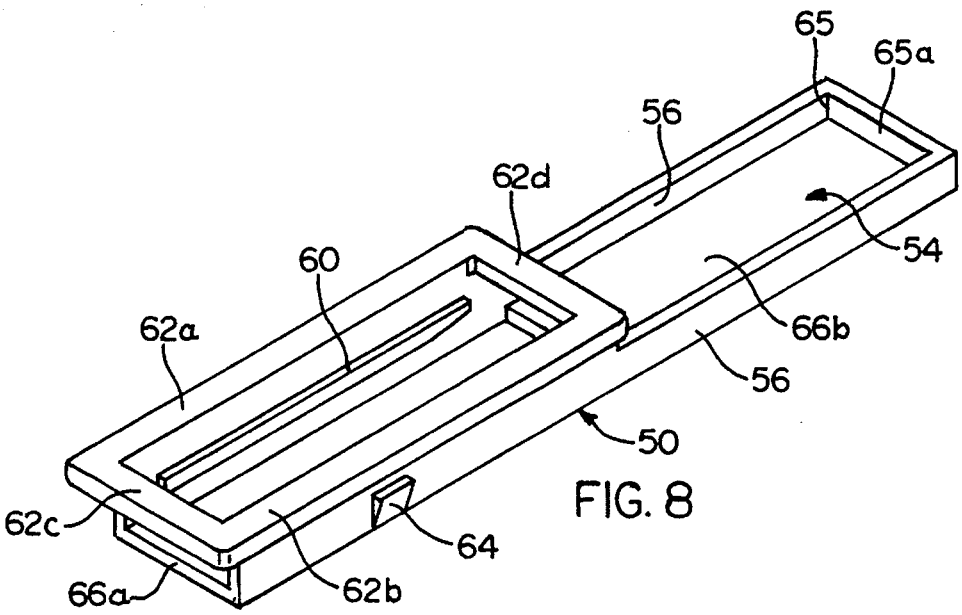
FIG. 8 is a-perspective view of a body member of the humidity control assembly in isolation.

As shown in the Figures, the body member 50 has a bottom wall 54, a pair of spaced apart and opposed side walls 56 and a top opening 58. The sidewalls 56 have inwardly extending rails 60 which extend along approximately one half of the length of the sidewalls 56 and are spaced slightly above the bottom wall 54. The sidewalls 56 also have outwardly extending flanges 62*a,b* at a top end thereof extending approximately one half of the length of the sidewalls and beginning at a first end 63 thereof. Cross members 62*c,d* connect the flanges 62*a,b* to form a rectangle. Spaced below the flanges 62*a,b* by approximately the thickness of the front wall 34 of the pan 26 are outwardly extending detents 64 which protrude slightly from the sidewalls 56 in a wedge shape, tapered upwardly and outwardly. The detents 64 are preferably provided at approximately one fourth of the length of the sidewall 50 from the first end 63, centered under the flanges 62*a,b*. The sidewalls 56 extend at a first height from the first end 63 along approximately one half the length of the body 30, and include the flanges 62*a,b* extending therefrom, and then proceed at a shorter height for the remainder of the length of the body to a second end 65 as best seen in FIGS. 4 and 8. A rear wall 65*a* connects the sidewalls 56 at the end 65.

The bottom wall 54 of the body member 50 has a short segment 66*a* at the first end 63 and a long segment 66*b* of approximately one half of the length of the body member 50 extending below the short height portion of the sidewalls 56. A rectangular opening 67 extends between the two wall segments 66*a*, 66*b* which is nearly one half of the length of the body member.

Figure 9:
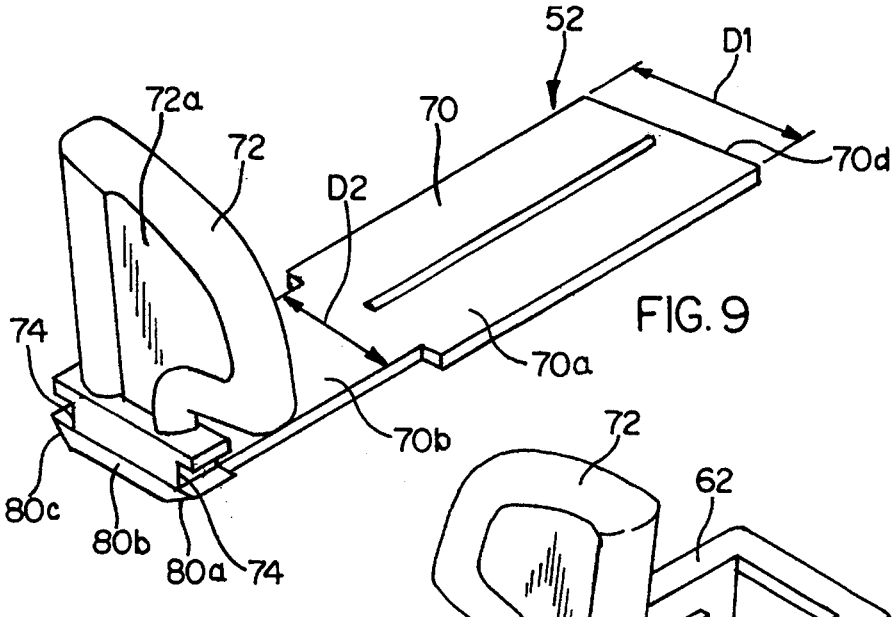
FIG. 9 is a perspective view of a slide member of the humidity control assembly in isolation.
Figure 10:
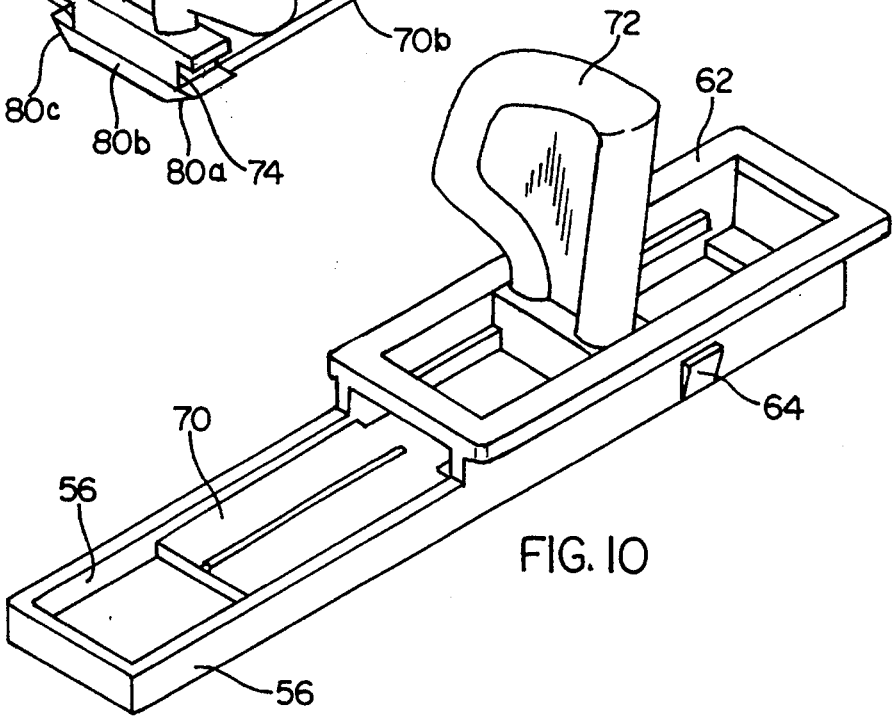
FIG. 10 is a perspective view of the humidity control assembly in isolation.

The second component for the humidity control assembly is the slide member 52, shown in FIG. 9, which has an elongated flat portion 70, with a thickness approximately the same as or slightly smaller than the space between the bottom wall 54 and the rails 60, such that the bottom wall 54 and rails 60 provide a track which will slidingly receive the flat portion 70 of the slide member, The slide member also has an upwardly extending handle portion 72 extending from the flat portion 70 and which includes grooves 74 to receive the inwardly protruding rails 60 such that the handle portion will easily slide along the rails and be supported by them.

The handle portion 72 includes a flat web 72*a* surrounded by a raised piping 72*b* which allows for easy and secure gripping at the handle 72 during operation.

The slide member 52 has a length less than the length of the body member 50 and the slide can be moved along the track to close or cover varying desired amounts of the opening 67 in the bottom wall 54 of the body member.

As shown in FIG. 9, the slide member flat portion 70 has a contoured profile. A first portion 70*a* has a wide width D1 which is only slightly smaller than the clearance between the sidewalls 56 to allow close fit therebetween. A second portion 70*b* has a smaller width D2 which is slightly smaller than a clearance between the rails 60 to allow passage therebetween during assembly. A third portion 70*c*, directly below the handle 72, has the wide width D1, and the third portion has beveled bottom edges 80*a,b,c* on three perimeter sides (see FIGS. 4, 5 and 9).

In order to assemble the humidity control assembly itself and then to assemble it to the crisper pan, first the slide member 52 is slid into the body member 50 with the handle portion 72 being inserted last. To install the slide member 52 into the body portion 50, first a leading edge 70*d* of the first portion 70*a* of the flat portion 70 is fit and slid through the gap G (shown in FIG. 4) between the rails 60 and the cross member 62*d* and moved to the right of FIGS. 4 and 7, until the first portion 70*a* clears the rails 60. The edges 80*a*, 80*c* will then be on top of the rails 60. A downward force is exerted to deflect the sidewalls 56 outwardly until the rails pass by the edges 80*a*, 80*c* and enter the grooves 74. The slide member 52 can now be slid back and forth with the rails 60 riding in the grooves 74. The beveled edges 80*a*, 80*b*, 80*c* allow a deflection and an outward separation of the sidewalls 56 to allow the rails to pass into the grooves during assembly. Because the second portion 70*b* has the smaller width D2, it can freely pass between the rails 60.

The short height end 65 of the body is pushed into the rectangular opening 35 in the crisper pan front wall 34 and, in the configuration illustrated in the drawings, is slid to the right so that the end 65 will be positioned behind the wall 34 of the pan 32 until an edge of the higher part of the wall 56 engages the right hand edge of the opening in the pan front wall. Then the humidity control assembly is pivoted and the end 63 is pushed into the opening 35 in the crisper pan until the detents 64 pass through the opening and are engaged on the back side of the front wall 34. At this time the flanges 62*a,b* and cross members 62*c,d* will be flush against a front surface of the front wall 34 so that the humidity control assembly will be securely retained in the front wall of the crisper pan as seen in FIG. 4. The slide member 52 will continue to be free to slide within the body member 50 in this assembled condition.

The crisper wall 34 is thus clamped, located between the flanges 62*a, b* and cross members 62*c, d* and the detents 64 and short portion of the sidewalls 56 and end wall 65*a*. The short portion of the side walls 56, the end wall 65*a* and the long segment 66*b* of the bottom wall 54 provide an enclosure for the flat portion 70 against a back surface 34*a* of the crisper wall 34 to protect against food or grime contamination of the slide member 52, detrimental to operation.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. A crisper pan and humidity control slide assembly, comprising:

a crisper pan front wall including a rectangular opening;

a humidity control slide having a slide body for receiving a control slide member;

said slide body having at least one slot opening, a track for said control slide member to move in, wherein said track is formed by a pair of rails extending inwardly from parallel sidewalls of said body spaced above a bottom wall of said body; and outwardly extending detents for holding said slide body in said rectangular opening in said crisper pan;

said control slide member being positioned within the slide body to cover said slot opening and being selectively positionable within said slide body along said track to selectively uncover said slot for adjusting the uncovered size of said slot opening, wherein said slide control member has a contoured profile along its length with a portion that has a width less than a clearance between said rails and rail engaging elements extending outwardly from opposite sides of said contoured profile, said rail engaging elements each having an edge portion adapted to underlie said rails.

2. An assembly according to claim 1, wherein said body has a pair of parallel sidewalls each with an outwardly extending flange for engaging an outer surface of said crisper pan front wall, said outwardly extending flange being spaced from at least one detent projection which extends outwardly from said sidewalls for engaging an inner surface of said crisper pan front wall when said slide body is inserted into said opening.

3. An assembly according to claim 1, wherein said sidewalls have sufficient flexibility to allow forcible passing of said edge portions past said rails during assembly.

4. An assembly according to claim 1, wherein said slide body has a length greater than a length of said rectangular opening.

5. An assembly according to claim 1, wherein said control slide member includes a handle portion extending beyond a margin of said slide body for manual engagement by a user.

6. An assembly according to claim 1, wherein said detents comprise a pair of wedge shaped projections extending outwardly from said slide body.

7. A humidity control slide assembly comprising:

a slide body having a pair of sidewalls and a bottom wall; and a slide member having a flat portion and a handle portion, wherein said slide member has a contoured profile along its length with a portion that has a width less than a clearance between said rails and rail engaging elements extending outwardly from opposite sides of said contoured profile, said rail engaging elements each having an edge portion adapted to underlie said rails;

said slide body including a pair of rails extending inwardly from said sidewalls and spaced above said bottom wall to form a track for movably receiving said flat portion of said slide member and an opening in said bottom wall selectively covered by said slide member as it is moved along said track, said sidewalls having a first height along a first portion of their length, a second shorter height along a remainder of their length and outwardly extending flanges at a top edge of said first portion of said length.

8. An assembly according to claim 7, wherein said handle portion extends approximately perpendicular to said flat portion.

9. An assembly according to claim 8, wherein said handle portion extends beyond said first height of said first portion of said sidewalls.

10. An assembly according to claim 7, wherein said handle portion includes grooves for receiving said rails.

11. An assembly according to claim 7, wherein said first portion of said sidewalls extends along approximately one half of a length of said sidewalls.

12. An assembly according to claim 7, wherein said opening in said bottom wall extends approximately the length of said first portion of said sidewalls.

13. An assembly according to claim 7, wherein a wedge shaped detent is provided on each sidewall extending outwardly therefrom at said first portion.

14. An assembly according to claim 7, wherein said rails extend only along a length of said first portion of said sidewalls.

15. An assembly according to claim 7, wherein said flat portion of said slide member has a length at least as long as a length of said opening.

16. An assembly according to claim 7, wherein said sidewalls have sufficient flexibility to allow forcible passing of said edge portions past said rails during assembly.

* * * * *